US008270884B2

(12) United States Patent
Matsubara et al.

(10) Patent No.: US 8,270,884 B2
(45) Date of Patent: Sep. 18, 2012

(54) IMAGE FORMING METHOD USING TWO PRESSURE STEPS

(75) Inventors: Masaharu Matsubara, Tokyo (JP); Shigenori Kouno, Tokyo (JP); Mitsutoshi Nakamura, Aichi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 168 days.

(21) Appl. No.: 12/827,730

(22) Filed: Jun. 30, 2010

(65) Prior Publication Data

US 2011/0033211 A1 Feb. 10, 2011

(30) Foreign Application Priority Data

Aug. 8, 2009 (JP) ..... 2009-161912

(51) Int. Cl.
*G03G 15/16* (2006.01)

(52) U.S. Cl. ..... 399/296; 399/307

(58) Field of Classification Search ..... 399/148, 399/296, 307

See application file for complete search history.

(56) References Cited

U.S. PATENT DOCUMENTS

2005/0141926 A1* 6/2005 Baker et al. ..... 399/296

FOREIGN PATENT DOCUMENTS

| | | |
|---|---|---|
| JP | 51122449 | 10/1976 |
| JP | 51137421 | 11/1976 |
| JP | 57186757 | 11/1982 |
| JP | 58072156 | 4/1983 |
| JP | 2007212739 | 8/2007 |

* cited by examiner

*Primary Examiner* — Hoang Ngo
(74) *Attorney, Agent, or Firm* — Lucas & Mercanti, LLP

(57) ABSTRACT

An image forming method using toner comprising toner particles having a core-shell structure comprising a core particle incorporating a viscous material and a shell layer covering the above core particle is disclosed. The method comprises steps of a toner image forming step on a dielectric drum; a first pressure applying step in which the shell layer of the toner particles forming the toner image is subjected to a preliminary break treatment by a first pressure roller, which is arranged in contact with the dielectric drum; and a transfer/fixing step in which a toner image made by the toner particles which have been subjected to a preliminary break treatment by the first pressure applying step is transferred and fixed to an image support by a second pressure roller which is arranged in contact with the dielectric drum.

22 Claims, 1 Drawing Sheet

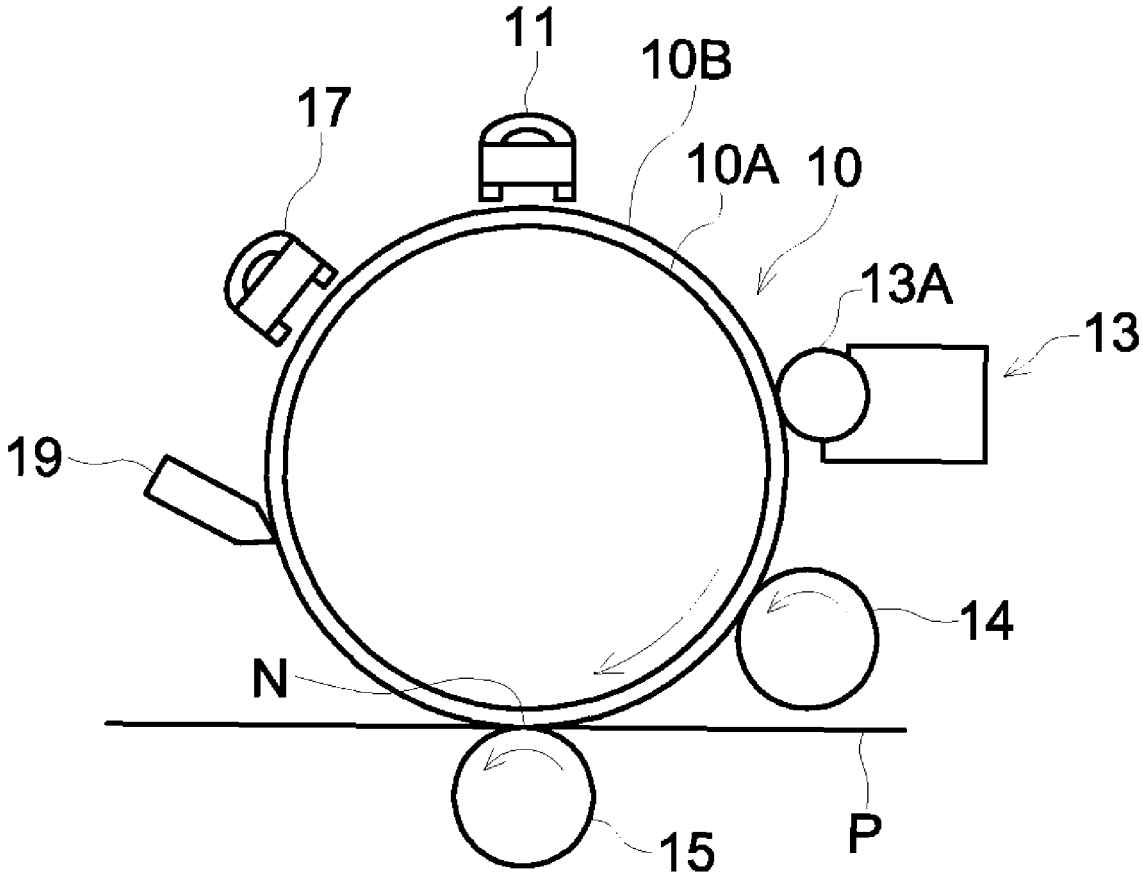
11
10B
17
10A
10
13A
13
19
14
N
15
P

IMAGE FORMING METHOD USING TWO PRESSURE STEPS

This application is based on Japanese Patent Application No. 2009-161912 filed on Jul. 8, 2009, in Japanese Patent Office, the entire content of which is hereby incorporated by reference.

FIELD OF TECHNOLOGY

The present invention relates to an image forming method, in which a toner image formed on a dielectric drum is transferred and fixed to an image support by pressure.

BACKGROUND ART

In recent years, from the point of view of the prevention of global warning, energy conservation has been studied in various fields. Also in information equipment such as an image forming apparatus, efforts such as electric power saving in standby mode are underway so that the above image forming apparatus can be used at low energy, and further, in a fixing process in which energy is consumed in highest amounts, methods for such as lowering a fixing temperature have been studied. Lowering a fixing temperature decreases energy required for the fixing itself, as well as reducing a warm up time (WUT).

The final goal of lowering a fixing temperature is achieved by a pressure fixing method, in which a fixing is carried out only by applying pressure without using heat at all, and the method has been studied (refer, for example, to Patent Documents 1 and 2).

However, in a fixing method, in which both heat and pressure are applied, a fixing can be achieved with small pressure, since pressure is applied to toner particles which are in a state of being melted and deformed by heat, but in a pressure fixing method, high pressure is required to be applied to toner particles, since the toner particles have to be plastically deformed only by pressure. As a result, an apparatus having a larger size or heavier weight is required. Further, in case where a paper is used as an image support, since irregularity exists on the surface of the paper due to paper fibers of larger scale than a toner particle, it is necessary to apply considerably high pressure to uniformly plastically deform toner on the paper. However, in case where a fixing is carried out at a high pressure to the extent that toner is uniformly plastically deformed on the paper, the damage on paper is heavy to result in a problem that a high quality print can not be obtained.

As a method for solving such a problem, a method for using microcapsule toner is disclosed in, for example, Patent Document 3. However, in case where capsulation is insufficient, there exists a problem that a core material oozes out resulting in generation of toner aggregation in a development apparatus.

In Patent Document 4, it is disclosed that a viscous material, such as resin and ethylene vinyl acetate copolymer resin (EVA) exhibiting viscosity at the normal temperature and a low glass transition temperature (Tg), is introduced into a core material of toner particles to improve fixing property to paper. However, in such toner, it was difficult to obtain sufficient heat resistant storage properties.

In a method using such microcapsule toner, it has been studied for toner particles, having core particles comprising a resin component and a shell layer covering the core particles, to improve fixing properties by making the shell layer thin (refer to Patent Document 5). However, there exists a problem that sufficient heat resistant storage properties can not be obtained without having a certain degree of thickness in the shell layer.

PRIOR ARTS

Patent Document 1: Japanese Patent Application Publication (hereinafter also referred to as JP-A) No. 51-122449
Patent Document 2: JP-A No. S58-72156
Patent Document 3: JP-A No. S57-186757
Patent Document 4: JP-A No. S51-137421
Patent Document 5: JP-A No. 2007-212739

SUMMARY OF THE INVENTION

The present invention was achieved based on the above circumstances, and the object thereof is to provide an image forming method, in which, in a pressure fixing methods, even in a case where toner having sufficient heat resistant storage properties can be obtained is used, high fixing properties can be obtained while pressure applied to an image support is reduced.

The image forming method of the present invention is characterized in that the above method undergoes the following steps using toner comprising toner particles having a core-shell structure comprising a core particle incorporating a viscous material and a shell layer covering the above core particle: a step of forming a toner image on a dielectric drum; the first pressure applying step in which the shell layer of the toner particles forming the aforesaid toner image is subjected to a preliminary break treatment by the first pressure roller, which is arranged in contact with the above dielectric drum; and a transfer/fixing step in which a toner image made by the toner particles which are subjected to a preliminary break treatment by the above first pressure applying step is transferred and fixed to an image support by the second pressure roller which is arranged in contact with the above dielectric drum.

In the image forming method of the present invention, the pressure strength of the first pressure roller to the dielectric drum is preferably 1 to 10 kg/cm in linear pressure.

Further, the pressure strength of the second pressure roller to the dielectric drum is preferably 5 to 15 kg/cm in linear pressure.

In the image forming method of the present invention, the above viscous material preferably exhibits a glass transition temperature (Tg) in a range of from −30° C. to 5° C.

In the image forming method of the present invention, a content ratio of the above viscous material in the core particles of the above toner particles is preferably 10 to 30% by mass.

In the image forming method of the present invention, the above viscous material is preferably a styrene-acrylic resin or an ethylene vinyl acetate copolymer resin (EVA).

In the image forming method of the present invention, silicone oil of 2 to 20% by mass is preferably incorporated in the core particles of the above toner particles.

Further, in the image forming method of the present invention, the above shell layer is preferably composed of a resin having a glass transition temperature (Tg) of 60° C. or higher.

According to the image forming method of the present invention, in order to briefly preliminarily break a toner image on the dielectric drum comprising toner particles having a core-shell structure, which toner particles exhibit sufficient heat resistant storage properties, by applying a small pressure with the first pressure roller in the first pressure applying step, each of toner particles constituting the toner image is crashed to some extent, thereby the toner image is preliminarily broken. After that, in case where the toner image composed of the preliminarily broken toner particles is transferred and fixed to the image support by the second pressure roller, sufficiently high fixing properties can be obtained by a small pressure applied by the second pressure roller, since the aforesaid toner particles incorporate a viscous material as the constituting material of the core particles.

For example, even in case where a paper is used as the image support, viscous materials can be intruded or forced into irregularities caused by paper fibers with a small pressure to capture the paper. As a result, sufficiently high fixing properties can be obtained without the paper being greatly damaged.

BRIEF DESCRIPTION OF THE DRAWING

FIG. 1 is a schematic depiction describing an outline of a constitution of an image forming apparatus used in the image forming method of the present invention.

DESCRIPTION OF THE INVENTION

The image forming method of the present invention will be detailed below.

The image forming method of the present invention is a method which undergoes the following steps using toner comprising toner particles having a core-shell structure comprising a core particle incorporating a viscous material and a shell layer covering the above core particle: a step of forming a toner image on a dielectric drum; the first pressure applying step in which the shell layer of the toner particles forming the aforesaid toner image is subjected to a preliminary break treatment by the first pressure roller which is arranged in contact with the above dielectric drum; and a transfer/fixing step in which a toner image made by the toner particles which are subjected to a preliminary break treatment by the above first pressure applying step is transferred and fixed to an image support by the second pressure roller which is arranged in contact with the above dielectric drum.

[Image Forming Apparatus]

The image forming apparatus used in the image forming method of the present invention will be described.

As shown in FIG. 1, the image forming apparatus is provided with a dielectric drum 10 which is a rotatable image bearing body and the following plurality of means, each of which means is arranged along the outer periphery of the dielectric drum 10 in the order with respect to the rotating direction of the dielectric drum 10: an electrostatic latent image forming means 11 which forms an electrostatic latent image on the dielectric drum 10; a developing means 13 which forms a toner image by visualizing the latent image using a developer incorporating toner; a preliminary break means comprising a first pressure roller 14, by which the shell layer of toner particles constituting a toner image on the dielectric drum 10 is subjected to a preliminary break treatment; a transfer/fixing means comprising a second pressure roller 15, in which a toner image on the dielectric drum 10, which image is composed of toner particles which were subjected to a preliminary break treatment, is transferred and fixed to a image support P at a transfer/fixing region; a cleaning means 19 which removes non-transferred toner remaining on the dielectric drum which passed the transfer/fixing region; and a discharging means 17 which deletes a small amount of remaining electrostatic latent image remaining on the dielectric drum 10.

The dielectric drum 10 is constituted of a drum-shaped conductive substrate 10A and a dielectric layer 10B made of a dielectric material formed on the outer periphery of the above conductive substrate 10A, and is arranged in a state extending in a perpendicular direction with respect to the paper surface of FIG. 1.

The line speed, when the above dielectric drum 10 is rotated, is set, for example, in a range of 400 to 600 mm/sec.

The material constituting the dielectric substrate 10A includes, for example, aluminum and an aluminum alloy.

As the material constituting dielectric layer 10B, usable are various generic organic or inorganic dielectric materials.

The dielectric layer 10B is allowed to have a general thickness.

The dielectric drum 10 has a different surface energy from that of the first pressure roller 14. Specifically, when the first pressure roller 14 is peeled off the dielectric drum 10 after a toner image formed on the dielectric drum 10 was subjected to a preliminary break treatment, the adhesive force to toner particles on each of the surfaces differs from each other.

Such difference in energy can be achieved, for example, by a coating treatment using Teflon (a registered trademark), or a treatment with silica via a sol-gel method on the surface of the first pressure roller 14.

The electrostatic latent image forming means 11 is a means to form an electrostatic latent image on the dielectric layer 10B by controlling ion flow generated from an ion generation source, and is constituted, for example, of a corona discharger for generating ions, in which discharger electrodes for electric discharge, which are made of metal wires, are arranged in a metal case, and of control electrodes which control ion flow.

The developing means 13 is composed by arranging, for example, a developing sleeve 13A with a built-in magnet which rotates while keeping a developer, and a voltage applying apparatus (not illustrated) which applies bias voltage between the dielectric drum 10 and the above developing sleeve 13A.

The preliminary break means is composed of the first pressure roller 14 which is arranged so as to be pressure contacted to the dielectric drum 10, and is allowed to rotate, for example, in the same direction as the dielectric drum 10.

The above first pressure roller 14 is made, for example, of a metal roller on which surface is coated by Teflon (a registered trademark).

The outer diameter of the first pressure roller 14 is set to be, for example, 35 mm.

The pressure strength of the first pressure roller 14 to the dielectric drum 10 varies depending on physical properties such as a thickness of the shell layer of toner to be employed; the pressure strength of the second pressure roller 15 to the dielectric drum 10; and with or without a coating on the surface of the image support P, but is preferably 1 to 10 kg/cm in linear pressure, more preferably 2 to 7 kg/cm in linear pressure.

In case where the pressure strength of the first pressure roller 14 to the dielectric drum 10 is excessively small, toner particles may not sufficiently be subjected to the preliminary break treatment, thereby sufficient fixing to the image support P may not be performed. On the other hand, in case where the pressure strength of the first pressure roller 14 to the dielectric drum 10 is excessively large, the image forming apparatus may become larger, and further, an image at an edge portion may be shifted in a visual image to be formed, since toner particles are shifted by the aforesaid first pressure roller 14 at an edge portion of the first pressure roller 14.

The transfer/fixing means is composed of the second pressure roller 15 which is arranged so as to be pressure contacted to the dielectric drum 10, and the second pressure roller 15 is allowed to rotate in the same direction as the dielectric drum 10. By the pressure contact portion of the above dielectric drum 10 to the second pressure roller 15, a transfer/fixing nip portion N is formed.

As the second pressure roller 15, usable is a soft roller composed of a cylindrical core metal comprising, for example, an iron; an elastic layer composed of an elastic body such as, for example, silicone rubber, which layer is formed on the outer periphery of the aforesaid core metal; and a covering layer composed of mold releasing resins such as, for example, fluororesin, which layer is formed on the outer periphery of the aforesaid elastic layer.

The outer diameter and the thickness of the core metal of the second pressure roller 15 are set to be, for example, 35 mm and 0.6 mm, respectively. The thickness of the elastic layer is set to be, for example, 7 mm, and the thickness of covering layer is set to be, for example, 10 to 50 μm.

The pressure strength of the second pressure roller 15 to the dielectric drum 10 varies depending on physical properties such as a thickness of the shell layer of toner to be employed; the pressure strength of the first pressure roller 14 to the dielectric drum 10; and with or without a coating on the surface of the image support P, but is preferably 5 to 15 kg/cm in linear pressure, more preferably 5 to 10 kg/cm in linear pressure.

In case where the pressure strength of the second pressure roller 15 to the dielectric drum 10 is excessively small, sufficient fixing to the image support P may not be performed. On the other hand, in case where the pressure strength of the second pressure roller 15 to the dielectric drum 10 is excessively large, in case where a low durability image support is used, the second pressure roller 15 may cause a great damage to the aforesaid image support.

The discharging means 17 is a means to cancel electric charges of a small amount of remaining electrostatic latent image, which remains on the dielectric layer 10B after the transfer/fixing steps of a toner image, and to deletes the above remaining electrostatic latent image. The specific constitution of the above discharging means 17 is not particularly limited, and can be selected from various constitutions as long as it can cancel electric charges of a small amount of remaining electrostatic latent image, which remains on the dielectric layer 10B after the transfer/fixing steps of a toner image.

The cleaning means 19 is composed, for example, of a rubber blade, which is made of an elastic body such as, for example, polyurethane rubber. The base end section of the cleaning means 19 is supported by a supporting member (not illustrated), and the tip section thereof is set to be arranged so as to be brought into close contact with the surface of the dielectric drum 10. The extending direction from the base end side of the rubber blade is set to be opposite to moving direction, what is called a counter direction, by a rotation of the dielectric drum 10 at the close contact point.

The image forming method of the present invention is carried out in the following way using the image forming apparatus described above.

When the dielectric drum 10 is driven to rotate, a voltage is applied, in the electrostatic latent image forming means 11, between a discharge electrode of the corona discharger and the metal case, in a state that the metal case is used as a ground potential to generate a corona discharge, whereby positive ions come together around the discharge electrode, and at the same time, negative ions come together inside the metal case resulting in formation of ion flow. Due to the acceleration or obstruction of passage of the aforesaid ion flow by a control electrode, an electrostatic latent image is formed on the dielectric drum 10. Toner, charged with the same polarity as the surface potential of the dielectric drum 10 by the developing means 13, is adhered to the electrostatic latent image faulted on the dielectric drum 10, and then, a reverse development is carried out, whereby a toner image is formed.

The above toner image is pressed by being sandwiched between the dielectric drum 10 and the second pressure roller 15 at the transfer/fixing nip portion N so that a pressure is provided with the toner image, thereby the toner image is transferred to the image support P, which was conveyed at a prescribed timing by a conveying means (not illustrated), and at the same time the toner image is fixed.

The non-transferred toner, which passed the transfer/fixing region and remained on the dielectric drum 10, is removed by the rubber blade of the cleaning means 19. After that, a small amount of charges of the residual electrostatic latent image remained on the dielectric layer 10B is cancelled by the discharging means 17, thereby the residual electrostatic latent image is deleted.

[Image Support]

As the image support P of the image forming method of the present invention, an appropriate support may be used.

In the image forming method of the present invention, in particular, the effect can be clearly obtained even in case where a sheet of paper which is inferior in durability is used; the sheet of paper includes a regular paper including a thin paper and a thick paper, a high-quality paper, a coated printing paper such as a art paper and a coated paper, a commercially available Japanese paper or post card.

Namely, for example, even in case where a regular paper or a Japanese paper is used as the image support P, viscous materials can be intruded or forced into irregularities caused by paper fibers with a small pressure to capture the paper, and as a result, sufficiently high fixing properties can be obtained without the paper being greatly damaged.

[Toner]

Toner particles, constituting the toner used in the image forming method of the present invention, have a core-shell structure comprising core particles incorporating a viscous material and a shell layer covering the outer periphery of the above core particles.

The toner particle having the above core-shell structure preferably have a form in which the shell layer completely covers the core particle, and as long as the toner particle is in a state that a material component constituting the core particle does not ooze out, a form, in which a part of the core particle is exposed due to formation of cracks on the aforesaid shell layer, may be accepted.

The toner particles constituting the toner used for the image forming method of the present invention may, if desired, incorporate a coloring agent, a charge control agent, magnetic powder, or a mold release agent.

The charge control agent and the magnetic powder are preferably incorporated into the shell layer.

The coloring agent and the mold releasing agent are preferably incorporated into the core as the material component constituting the core particle, but may be incorporated into the shell layer.

[Core Particle]

A viscous material is incorporated into the core particle of the above toner particle.

The term "viscous material" indicates a material which has a glass transition temperature (Tg) of from −30° C. to 5° C., and exhibits viscosity at 25° C. (the normal temperature). The weight average molecular weight (Mw) determined by gel permeation chromatography (GPC) is preferably 5,000 to 30,000, and more preferably 10,000 to 25,000.

The viscous material specifically includes, for example, gum arabic; styrene-acryl resin having a glass transition temperature (Tg) in the range of −30° C. to 5° C. and latex thereof; ethylene-vinyl acetate copolymer resin (EVA); petroleum residue such as liquid polybutene, liquid polychloroprene, liquid polybutadiene, epoxidation triglyceride, epoxidation monoester, adipic acid derived polyester, liquid polyester, chlorinated paraffin, trimellitic acid ester, polymethyl acrylate, polybutyl acrylate, polybutyl methacrylate, polylauryl methacrylate, acrylate oligomer, oligomer of a styrene type monomer, oligomer of styrene-alkylacrylate copolymer, oligomer of styrene-alkylmethacrylate copolymer, polyvinyl acetate, asphalt, and gilsonite; esters of unsaturated fatty acid such as linoleic acid, linolenic acid, oleic acid, elaidic acid, eleostearic acid, linolenelaidic acid, gadolenic acid, erucic acid, arachidonic acid, clupanodonic acid, α-licanic acid; synthetic drying oils such as acetylene-butadiene copolymer, and dicyclopentadiene oligomer. Of these, ethylene-vinyl acetate copolymer resin (EVA) is particularly preferred.

These compounds may be used singly or in combination of two or more.

These viscous materials are preferably incorporated into core particles by 10 to 30% by mass with respect to 100% by mass of core particles. Due to incorporation of the viscous material into the core particles in the above range with respect to 100% by mass of core particles, sufficient fixing properties to the image support P can be obtained. On the other hand, in case where the viscous material is less than 10% by mass with respect to 100% by mass of core particles, sufficient fixing properties to the image support P can not be obtained. In case where the viscous material is more than 30% by mass with respect to 100% by mass of core particles, the aforesaid viscous material oozes outside in the first pressure applying step and transfer/fixing step, which may cause contamination of the dielectric drum, the first pressure roller 14, and the second pressure roller 15.

The core particles preferably incorporate silicone oil in addition to the viscous materials. The content of the silicone oil in the core particles is preferably from 2 to 20% by mass with respect to 100% by mass of the core particles. Due to incorporation of the silicone oil into the core particles in the above range with respect to 100% by mass of core particles, the surface of a visible image being formed is made smooth, thereby separation of the aforesaid visible image can be greatly restrained.

Further, the core particles preferably incorporate other resins than the viscous material. The other resins include, for example, styrene-acryl resins having a glass transition temperature of 5° C. or higher. The styrene-acryl resins include resins described below, which are obtained by polymerization of vinyl monomers.

The vinyl monomers include styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene; methacrylic acid ester derivatives such as methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; acrylic acid ester derivatives such as methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate, and phenyl acrylate; olefins such as ethylene, propylene, and isobutylene; halogenated vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether, and vinyl ethyl ether; vinyl ketones such as vinyl methyl ketone, vinyl ethyl ketone, and vinyl hexyl ketone; N-vinyl compounds such as N-vinyl carbazole, N-vinyl indole, and N-vinyl pyrrolidone; vinyl compounds such as vinylnaphthalene, and vinylpyridine; acrylic acid or methacrylic acid derivatives such as acrylonitrile, methacrylonitrile, and acrylamide. These vinyl monomers may be used singly or in combination of two or more.

As the vinyl monomers to form the above-described styrene-acryl resins, the vinyl monomers having an ionic dissociation group are preferably used in combination thereof. The vinyl monomers having an ionic dissociation group include, for example, compounds having, as a constituent group of the monomer, a substituent group such as a carboxyl group, a sulfonate group, and a phosphate group. The specific compounds include acrylic acid, methacrylic acid, maleic acid, itaconic acid, cinnamic acid, fumaric acid, monoalkyl maleate, monoalkyl itaconic acid ester, styrenesulfonic acid, alkylsulfosuccinic acid, 2-acrylamido-2-methylpropanesulforfic acid, acid phosphooxyethyl methacrylate, and 3-chloro-2-acid phosphooxypropyl methacrylate.

Further, the styrene-acryl resins may also be composed of vinyl polymers having a bridged structure using multifunctional vinyls, as the vinyl monomers to form the styrene-acryl resins, which multifunctional vinyls include divinylbenzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate, and neopentylglycol diacrylate.

Such core particles preferably have a glass transition temperature (Tg) of from 0 to 25° C.

Core particles, having the glass transition temperature (Tg) in the above range, give a sufficient fixing to the image support P. On the other hand, in case where the glass transition temperature (Tg) is less than 0° C., core particles may ooze outside due to the preliminary break treatment in the first pressure applying step, which may cause contamination of the dielectric drum and the aforesaid first pressure roller. In case where the glass transition temperature (Tg) of the core particles is more than 25° C., the fixing to the image support P may become insufficient.

The glass transition temperature (Tg) is determined by using a DSC-7 Differential Scanning calorimeter (manufactured by Perkin Elmer) and a TAC7/DX Thermal Analysis Instrument Controller (manufactured by Perkin Elmer). Specifically, 4.50 mg of core particles were sealed in an aluminum pan (KIT No. 0219-0041), which was then set to a sample holder of the DSC-7. Using an empty aluminum pan as a reference, the above sample was subjected to temperature control of a heat-cool-heat from 0° C. to 200° C. with measurement conditions of a rate of temperature increase of 10° C./min and a rate of temperature decrease of 10° C./min, and data at the $2^{nd}$ heat were obtained. The point of intersection of an extension line from the baseline prior to the rise of the first endothermic peak with the tangent line exhibiting the maximum slope between the rise of the first endothermic peak and the peak of the curve was taken as the glass transition temperature (Tg). The step of the temperature increase of the $1^{st}$ heat was held for 5 minutes at 200° C.

The weight average molecular weight (Mw) determined via a gel permeation chromatography of the core particles is preferably 5,000 to 15,000, more preferably 5,000 to 10,000. The ratio of the weight average molecular weight (Mw) to the number average molecular weight (Mn), namely Mw/Mn, of the core particles is preferably 1.0 to 5.5, more preferably 1.5 to 3.5.

The molecular weight determination via the GPC is carried out as described below. Using an apparatus of HLC-8220 (manufactured by Tosoh Corp.) and a triple column of TSK-guardcolumn+TSKgelSuperHZM-M 3 series (manufactured by Tosoh Corp.), tetrahydrofuran (THF) as a carrier solvent is poured at a flow rate of 0.2 ml/min, while holding the column temperature at 40° C. The core particles are dissolved in tetrahydrofuran to a density of 1 mg/ml at a condition of dissolving the core particles at room temperature over five minutes using an ultrasonic homogenizer. Subsequently, the resulting solution is forced through membrane filters of a pore size of 0.2 μm to obtain a sample solution followed by injection of 10 μl of the sample solution into the apparatus together with the above carrier solvent, and then, detection is carried out using a refractive index detector (RI detector). The molecular weight distribution of the measurement sample is calculated using a calibration curve measured using a calibration curve measured using monodispersed polystyrene standard particles. As the standard polystyrene particles for the determination of the calibration curve, the particles manufactured by Pressure Chemicals Co. having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ are used, and at least about ten standard polystyrene samples are measured to prepare a calibration curve. As a detector, a refractive index detector is used.

[Shell Layer]

The shell layer constituting the toner particle is composed of resins incompatible with material components constituting the core particle (hereinafter also referred to as "shell resins"), and the shell layer may have a multilayered structure comprising at least two layers composed of shell resins of at least two kinds having different compositions.

The shell resins include, for example, resins incorporating polymers prepared by polymerization of at least one kind of vinyl monomer as a constituent. The vinyl monomers include styrene or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene; methacrylic acid ester derivatives such as methyl methacrylate, ethyl methacrylate, n-butyl methacrylate, iso-propyl methacrylate, iso-butyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate; acrylic acid ester derivatives such as methyl acrylate, ethyl acrylate, iso-propyl acrylate, n-butyl acrylate, t-butyl acrylate, iso-butyl acrylate, n-octyl acrylate, 2-ethylhexyl acrylate, stearyl acrylate, lauryl acrylate, and phenyl acrylate; olefins such as ethylene, propylene, and isobutylene; halogenated vinyls such as vinyl chloride, vinylidene chloride, vinyl bromide, vinyl fluoride, and vinylidene fluoride; vinyl esters such as vinyl propionate, vinyl acetate, and vinyl benzoate; vinyl ethers such as vinyl methyl ether, and vinyl ethyl ether; vinyl ketones such as vinyl methyl ketone, vinyl ethyl ketone, and vinyl hexyl ketone; N-vinyl compounds such as N-vinyl carbazole, N-vinyl indole, and N-vinyl pyrrolidone; vinyl compounds such as vinylnaphthalene, and vinylpyridine; acrylic acid or methacrylic acid derivatives such as acrylonitrile, methacrylonitrile, and acrylamide. These vinyl monomers may be used singly or in combination of two or more.

The shell resins constituting the shell layer preferably have its glass transition temperature (Tg) of 60° C. or more.

Due to the glass transition temperature (Tg) of the shell resins constituting the shell layer being 60° C. or more, the toner has high heat resistant storage properties, thereby generation of toner aggregation during storage can be restrained.

The glass transition temperature (Tg) of the shell resins is determined in the similar manner to the above method except that the measurement sample is changed to the shell resins.

The weight average molecular weight (Mw) determined via a gel permeation chromatography of the shell resins is preferably 8,000 to 25,000, more preferably 12,000 to 18,000, and the ratio of the weight average molecular weight (Mw) to the number average molecular weight (Mn), namely Mw/Mn, of the core particles is preferably 1.0 to 4.5, more preferably 1.5 to 2.5.

The molecular weight via the GPC of the shell resins is determined in the similar manner to the above method except that the measurement sample is changed to the shell resins.

The thickness of the shell layer is, depending on the average size of the toner and the pressure strength of the first pressure roller and the second pressure roller, preferably, for example, 100 to 300 nm. In case where the thickness of the shell layer is excessively small, materials constituting the core particles may ooze outside at the preliminary break treatment, and further the toner may not have high heat resistant storage properties, thereby toner aggregation during storage may be caused. On the other hand, in case where the thickness of the shell layer is excessively large, the shell layer can not be sufficiently broken at the preliminary break treatment, thereby sufficient fixing properties may not be performed with small pressure at transfer/fixing steps.

[Production Method of Toner Particles]

The method for producing such toner particles includes, for example, an emulsified dispersion method, a suspension polymerization method, a dispersion polymerization method, an emulsified polymerization method, an emulsion polymerization and coagulation method, and an encapsulation method, but is not limited to them as long as there can be produced toner particles having the core-shell structure comprising the core particles incorporating the viscous material and the shell layer covering the above core particles.

For example, in case of producing the toner particles using the emulsion polymerization and coagulation method, specifically dispersion of microparticles incorporating the viscous material, which particles were produced by the emulsified polymerization method, is mixed with other dispersion of toner constituting components such as coloring microparticles, and the resulting mixture is slowly coagulated while taking a balance between the power of repulsion of the surface of the microparticles by pH control and the coagulation power caused by addition of coagulant composed of electrolyte to carry out association while regulating an average particle size and a particle size distribution, and at the same time a shape control is carried out by fusion bonding of microparticles by stirring with heat, to achieve the production of the toner particles.

The microparticles incorporating the viscous material may have a constitution having at least two layers composed of resins having different compositions. In this case, the following method can be adopted: a polymerization initiator and a polymerizable monomer are added into a dispersion of the first resin microparticles prepared via the conventional emulsified polymerization treatment (the first step polymerization), and then, the resulting solution is subjected to a polymerization treatment (the second polymerization).

[Coloring Agent]

In case where the toner particles are constituted incorporating a coloring agent, commonly known various types of organic or inorganic pigments of various kinds or colors are usable as the coloring agent.

The amount of the coloring agent to be added is preferably 0.5 to 20 parts by mass with respect to 100 parts by mass of the toner resins, and more preferably 2 to 10 parts by mass.

[Magnetic Powder]

In case where the toner particles are constituted incorporating magnetic powder, for example, magnetite, γ-hematite, or various types of ferrite are usable as the magnetic powder.

The amount of the magnetic powder to be added is preferably 10 to 500 parts by mass with respect to 100 parts by mass of the toner resins, and more preferably 20 to 200 parts by mass.

[Charge Control Agent]

In case where the toner particles are constituted incorporating a charge control agent, commonly known various types of substance are usable as the charge control agent, but it is not limited to them as long as it is a substance which can provide a positive or negative charge through triboelectric charging.

Due to the constitution that the toner particles incorporate the charge control agent, charging properties of the toner are improved.

The amount of the charge control agent to be added is preferably 0.01 to 30 parts by mass with respect to 100 parts by mass of the toner resins, and more preferably 0.1 to 10 parts by mass.

[Releasing Agent]

Further, in case where the toner particles are constituted incorporating a releasing agent, commonly known various types of wax are usable as the releasing agent.

The amount of the releasing agent to be added is preferably 0.1 to 30 parts by mass with respect to 100 parts by mass of the toner resins, and more preferably 1 to 10 parts by mass.

[Particle Size of Toner Particles]

The volume based median size of the particle size of the toner particle is preferably 3 to 8 μm. With the volume based median size being 3 to 8 μm, reproduction of a narrow line or higher image quality of a photographic image can be achieved, and at the same time, toner consumption can be reduced compared to a case where a large size toner is used.

The volume based median size of the toner particles is measured and calculated using an measuring apparatus, such as "Coulter Multisizer III" (manufactured by Beckman Coulter Inc.) connected with a computer system loaded with "Software V3.51" for data processing. Specifically, the determination is carried out as follows: 0.02 g of toner is added and soaked in 20 ml of surface active agent solution, which is employed for the purpose of dispersion of the toner and is prepared, for example, by diluting a neutral detergent containing a component of surface active agent by a factor of 10 in pure water, and the resulting mixture is subjected to an ultrasonic dispersion for one minute to prepare a toner dispersion. Then the toner dispersion is charged using a pipette into a beaker containing "ISOTON II" (produced by Beckman Coulter Inc.), placed on a sample stand, to achieve a measured concentration of 8%. With the solution being in the above range of concentration, reproducible measurement values can be obtained. And then, with the counting number of the particles to be measured and the aperture size of the measuring apparatus being set to be 25,000 and 50 μm respectively, frequency values are calculated with a measuring range of 1 to 30 μm being divided into 256 parts, and the particle size at 50% from a larger number of a cumulative volume fraction is denoted as the volume based median size.

[Average Circular Degree of Toner Particles]

The average circular degree defined by the Formula (T) below of the toner used in the image forming method of the present invention is preferably 0.930 to 1.000 for each of the toner particles constituting the toner from a viewpoint of transfer efficiency, and more preferably 0.950 to 0.995.

Average circular degree=Circumference length of a circle calculated from a size of a equivalent circle/Circumference length of a projected particle image — Formula (T)

[External Additive]

The toner may be constituted of the above-described toner particles as they are, but the toner may be constituted of the aforesaid toner particles with addition of an external additive, which is so-called a post-treatment agent such as a fluidizer and a cleaning aid to improve fluidity, electrification characteristic, a cleaning property, and the like.

The post-treatment agent includes, for example, inorganic oxide microparticles comprising such as silica microparticles, aluminum microparticles, and titanium oxide microparticles; inorganic stearic acid compound microparticles such as aluminum stearate microparticles, and zinc stearate microparticles; and inorganic titanic acid compound microparticles such as a strontium titanate, and a zinc titanate. These may be used singly or in combination of two or more.

These inorganic microparticles are preferably subjected to a surface treatment with a silane coupling agent, a titanium coupling agent, a higher fatty acid, or silicone oil to improve heat resistant storage properties or an environmental stability.

The amount of the total of these various kinds of external additives to be added is 0.05 to 5 parts by mass with respect to 100 parts by mass of toner, and preferably 0.1 to 3 parts by mass. Various kinds of external additives may be used in combination thereof

[Developer]

The above-described toner may be used as a magnetic or non-magnetic single component developer, but may be used as a two-component developer by being mixed with carrier. In case where the toner is used as the single component developer, either the non-magnetic single component developer, or the magnetic single component developer, which is prepared by incorporating magnetic particles of about 0.1 to about 0.5 μm into the toner can be used. In case where the toner is used as the two-component developer, as the carrier, metals such as iron, ferrite, and magnetite, and magnetic particles comprising conventionally commonly known materials such as an alloy between the above metal and a metal such as aluminum and zinc, and in particular, ferrite particles are preferred. Further, as the carrier, there may be used coated carrier in which the surface of the magnetic particles are covered with a covering agent such as resins, or resin dispersed carrier in which magnetic particles are dispersed in binder resin.

According to the above image forming method, in order to briefly preliminarily break a toner image on the dielectric drum 10 comprising toner particles having a core-shell structure, which toner particles exhibit sufficient heat resistant storage properties, by applying a small pressure with the first pressure roller 14 in the first pressure applying step, each of toner particles constituting the toner image is crashed to some extent, thereby the toner image is preliminarily broken. After that, when the toner image composed of the preliminarily broken toner particles is transferred and fixed to the image support P by the second pressure roller 15, sufficiently high fixing properties can be obtained by a small pressure applied by the second pressure roller 15, since the aforesaid toner particles incorporate a viscous material as the constituting material of the core particles.

The embodiment of the present invention was specifically described above, but the embodiment of the present invention is not limited to the above-described example, and various alterations can be added.

EXAMPLES

Specific examples will be described below, but the present invention is not limited to them.

Synthesis Example 1 of Toner Particles

Preparation Example 1 of Resin Microparticle Dispersion for Core (1) The First Polymerization Into a 5 liter reaction vessel equipped with a stirrer, a temperature sensor, a cooling tube and a nitrogen gas introducing apparatus, 1,100 ml of ionized water was added, which vessel was then heated to 82° C. After that, to the above vessel added was a mixture solution, which was prepared by dissolving the following materials at 80° C. into a liquid solution in which 7 g of sodium polyoxyethylene (2) dodecylether sulfate was dissolved in 1,000 ml of ionized water:

| | |
|---|---|
| styrene (St) | 207 g |
| n-butylacrylate (BA) | 158 g |
| methacrylic acid (MAA) | 21 g |
| n-octyl-3-mercaptopropionate (NOMP) | 5.9 g |
| EVA (glass transition temperature (Tg): −30° C., Mw: 15,000) | 113 g |
| silicone oil | 34 g |

The resulting solution was mixed and dispersed over one hour via "CLEAMIX" (manufactured by M Technique Co., Ltd.), being a mechanical dispersion apparatus equipped with a circulation pathway, to prepare a dispersion liquid containing emulsified particles (oil droplets).

Subsequently, a polymerization initiator solution, in which 9.7 g of polymerization initiator (potassium persulfate: KPS) was dissolved into 170 ml of ionized water, was added to the above dispersion liquid, which solution was then polymerized by stirring and heating at 82° C. over one hour, to prepare a dispersion liquid of resin microparticles (1 HM). The weight average molecular weight (Mw) of the resin microparticles (1 HM) in the above dispersion liquid was 12,000.

(2) The Second Polymerization

Into the dispersion liquid of resin microparticles (1 HM), further added was a polymerization initiator solution, in which 11.4 g of polymerization initiator (potassium persulfate: KPS) was dissolved into 200 ml of ionized water, into which a monomer mixture solution composed of the following compounds was dropped over one hour under a temperature condition of 82° C.:

| | |
|---|---|
| styrene | 338 g |
| n-butylacrylate | 250 g |
| methacrylic acid | 37.6 g |
| n-octyl-3-mercaptopropionate | 10.9 g |

After the completion of the dropping, the mixture solution was subjected to polymerization by heating and stirring over two hours, and after that, the polymerized solution was cooled down to 28° C. to prepare a resin microparticle dispersion for core [1] in which resin microparticles for core [1] was dispersed. The weight average molecular weight (Mw), the glass transition temperature (Tg) and volume average particle size of the resin microparticles for core [1] in the resin microparticle dispersion for core [1] were 10,000, 9° C., and 165 nm, respectively. The volume average particle size was measured by employing a dynamic light scattering method particle size analyzer "Microtrac UPA150" (manufactured by Nikkiso Co., Ltd.).

Preparation Example 1 of Coloring Agent Microparticle Dispersion

While stirring a solution in which 58 g of sodium polyoxyethylene (2) dodecylether sulfate was dissolved in 3,300 ml of ionized water, 500 g of carbon black "Mogul L" (manufactured by Cabot Co.) was gradually added into the solution. Subsequently, the above solution was subjected to a dispersion treatment using a stirrer "CLEARMIX" (manufactured by M Technique Co., Ltd.), to prepare a coloring agent microparticle dispersion [A], in which coloring agent microparticles were dispersed. A particle size of the coloring agent microparticles in the coloring agent microparticle dispersion [A] was determined using a dynamic light scattering method particle size analyzer "Microtrac UPA150" (manufactured by Nikkiso Co., Ltd.) to obtain a volume average particle size of 150 nm.

Formation Example 1 of Core Particles [1]

Into a 5 liter reaction vessel equipped with a stirrer, a temperature sensor, a cooling tube and a nitrogen gas introducing apparatus, added were 330 g (equivalent converted to solids) of the resin microparticle dispersion for core [1], 1,140 ml of ionized water, and 35 g (equivalent converted to solids) of the coloring agent microparticle dispersion [A], together with a surface-active agent solution in which 3 g of sodium polyoxyethylene (2) dodecylether sulfate was dissolved in 120 ml of ionized water, and the temperature of the mixture solution was adjusted to 30° C., after which the pH of the solution was adjusted to 10 by adding a 5N aqueous solution of sodium hydroxide. Subsequently, an aqueous solution, in which 40 g of magnesium chloride was dissolved in 40 ml of ionized water, was added in the above solution, while stirring, over 10 minutes at 30° C. After standing the solution for 3 minutes, the temperature rising was started and the above system was heated to 70° C. over 60 minutes, and then a particle growth reaction was continued while keeping the temperature at 70° C. During the particle growth reaction, the particle size of the coagulated particles was determined using the "Coulter Counter 3" (Manufactured by Beckman Coulter Inc.). At a time when the volume based median size reached 6.0 μm, an aqueous solution, in which 6 g of sodium chloride was dissolved in 24 ml of ionized water, was added to stop the particle size growth. Further, as a ripening treatment, the fusion-bonding was continued by heating and stirring over one hour at the solution temperature of 70° C., to form core particles [1].

[Preparation Example of Shell Resin Microparticle Dispersion]

Into a 5 liter reaction vessel equipped with a stirrer, a temperature sensor, a cooling tube and a nitrogen gas introducing apparatus, added was a surface-active agent solution in which 2 g of an anionic surface-active agent represented by the Formula (Q) below was dissolved in 3,000 ml of ionized water. Then the solution temperature was raised to 80° C. while stirring at a stirring rate of 230 rpm under nitrogen gas flow.

Into the above surface-active agent solution, added was a polymerization initiator solution in which 10 g of polymerization initiator (potassium persulfate: KPS) was dissolved into 200 ml of ionized water, and after the temperature was adjusted to 75° C., a monomer mixture solution composed of the following compounds was dropped over one hour:

| | |
|---|---|
| styrene | 520 g |
| n-butylacrylate | 160 g |
| methacrylic acid | 120 g |
| n-octyl-3-mercaptopropionate | 22.3 g |

By conducting a polymerization reaction by heating and stirring the above system at 75° C. over two hours, a latex [LxS], in which shell resin microparticles [1] were dispersed, was obtained. The weight average molecular weight (Mw) and the glass transition temperature (Tg) of the shell resin microparticles [1] in the latex [LxS] was 15,000 and 62° C., respectively.

$C_{10}H_{21}(OCH_2CH_2)_2SO_3Na$ Formula (Q)

Formation Example 1 of Shell Layer

Into the reaction system relating to the above-described core particles [1], added at 70° C. was 49 g (equivalent converted to solids) of the shell resin microparticles [1], and then, stirring was continued over one hour, to result in formation of fusion-bonding of the shell resin microparticles [1] on the surface of the core particles [1]. After that, an aqueous solution, in which 54 g of sodium chloride was dissolved in 216 ml of ionized water to stop the shelling. Further, the fusion-bonding was allowed to continue by heating and stirring the solution over one hour after raising the solution temperature to 70° C. Then, the solution temperature was cooled down to 30° C. at a condition of 8° C./min, and the solid was separated from the solution using a basket-type centrifuge "MARK III: model number 60×40" (manufactured by Matsumoto Machine Co., Ltd.) to form a wet cake of toner matrix particles. The above wet cake was repeatedly rinsed with ionized water at 45° C. using the above-described basket-type centrifuge until an electric conductivity of the filtrate reached 5 μS/cm. After that the rinsed wet cake was transferred to "FLUSH JET DRYER" (manufactured by Seishin Enterprise Co., Ltd.), followed by drying until the moisture content reached 0.5% by mass to obtain toner matrix particles [1].

Addition Example 1 of External Additive

To the above toner matrix particles [1], added were hydrophobic silica (a number average primary particle size=12 nm, and a degree of hydrophobicity=68) to a rate of 1% by mass and hydrophobic titanium oxide (a number average primary particle size=20 nm, and a degree of hydrophobicity=63) to a rate of 12% by mass, and then, the mixture was blended using "Micro V-Type Mixer" (manufactured by Tsutsui Scientific Instruments Co., Ltd.) to obtain the toner [1] composed of the toner particles [1]. With respect to the toner particles [1] constituting the toner [1], some hydrophobic silica or hydrophobic titanium oxide did not change the shape and the particle size. Hereinafter, the same shall apply in the following paragraphs.

Synthesis Example 2 of Toner Particles

Preparation Example 2 of Resin Microparticle Dispersion for Core (1) Preparation of Viscous Material Latex Into a 5 liter reaction vessel equipped with a stirrer, a temperature sensor, a cooling tube and a nitrogen gas introducing apparatus, added was a surface-active agent solution in which 4 g of an anionic surface-active agent represented by the Formula (Q) below was dissolved in 3,040 ml of ionized water. Then the solution temperature was raised to 80° C. while stirring at a stirring rate of 230 rpm under nitrogen gas flow.

Into the above surface-active agent solution, added was a polymerization initiator solution in which 20 g of polymerization initiator (potassium persulfate: KPS) was dissolved into 400 nil of ionized water, and after the temperature was adjusted to 75° C., a monomer mixture solution composed of the following compounds was dropped over one hour:

| | |
|---|---|
| styrene | 328 g |
| n-butylacrylate | 424 g |
| methacrylic acid | 48 g |
| n-octyl-3-mercaptopropionate | 10.3 g |

By conducting a polymerization reaction by heating and stirring the above system at 75° C. over two hours, a latex [Lx1], in which shell resin microparticles [A] were dispersed, was obtained. The weight average molecular weight (Mw) and Tg of the shell resin microparticles [A] in the latex [Lx1] was 16,500 and 5° C., respectively.

$C_{10}H_{21}(OCH_2CH_2)_2SO_3Na$ Formula (Q)

(2) The First Polymerization

A monomer mixture solution composed of the following compounds was heated at 80° C. to prepare a monomer solution:

| | |
|---|---|
| styrene | 207 g |
| n-butylacrylate | 158 g |
| methacrylic acid | 21 g |
| n-octyl-3-mercaptopropionate | 6.1 g |
| silicone oil | 34 g |

On the other hand, a surface-active agent solution, in which 8.6 g of an anionic surface-active agent represented by the above-described Formula (Q) was dissolved in 1,100 ml of ionized water, was heated to 80° C., and the above-described monomer solution was mixed and dispersed over one hour via "CLEAMIX" (manufactured by M Technique Co., Ltd.), being a mechanical dispersion apparatus equipped with a circulation pathway, to prepare a dispersion liquid containing emulsified particles having a dispersion particle size of 340 nm.

Subsequently, after 11.3 g (equivalent converted to solids) of the above-described latex [Lx1] was added, a polymerization initiator solution, in which 11.3 g of potassium persulfate was dissolved into 214 ml of ionized water, was added to the above dispersion liquid, which solution was then subjected to a polymerization reaction (the first step polymerization) by heating and stirring at 80° C. over twelve hours, to prepare dispersion of resin microparticles (2HM). The weight average molecular weight (Mw) of the resin microparticles (2HM) in the dispersion was 11,500.

(3) The Second Polymerization

Into the above-described dispersion of resin microparticles (2HM), added was a polymerization initiator solution, in which 9.9 g of potassium persulfate was dissolved into 188 ml of ionized water, into which a monomer mixture solution composed of the following compounds was dropped over one hour under a temperature condition of 80° C.:

| | |
|---|---|
| styrene | 338 g |
| n-butylacrylate | 250 g |
| methacrylic acid | 37.6 g |
| n-octyl-3-mercaptopropionate | 18.1 g |

After the completion of the dropping, the mixture solution was subjected to a polymerization reaction (the second step polymerization) by heating and stirring over two hours, and after that, the polymerized solution was cooled down to 28° C. to prepare a dispersion of resin microparticles for core [2] in which resin microparticles for core [2] composed of composite resin particles was dispersed. The weight average molecular weight (Mw), the glass transition temperature (Tg) and volume average particle size of the resin microparticles for core [2] in the dispersion of resin microparticles for core [2] were 14,900, 0° C. and 190 nm, respectively. The volume average particle size was measured by employing a dynamic light scattering method particle size analyzer "Microtrac UPA150" (manufactured by Nikkiso Co., Ltd.).

Preparation Example 2 of Coloring Agent Microparticle Dispersion

While stirring a solution in which 90 g of anionic surface-active agent represented by the above-described Formula (Q) was dissolved in 1,600 ml of ionized water, 400 g of carbon black "Legal 330" (manufactured by Cabot Co.) was gradually added into the solution. Subsequently, the above solution was subjected to a dispersion treatment using a stirrer "CLEARMIX" (manufactured by M Technique Co., Ltd.), to prepare a coloring agent microparticle dispersion [B] in which coloring agent microparticles relating to a black coloring agent were dispersed. The particle size of the coloring agent microparticles in the coloring agent microparticle dispersion [B] was determined using a dynamic light scattering method particle size analyzer "Microtrac UPA150" (manufactured by Nikkiso Co., Ltd.) to be 110 nm in the volume-based median diameter.

Formation Example 2 of Core Particles

Core particles [2] was prepared in the same way as Formation Example 1 of Core Particles [1] except that the resin microparticles for core [2] and the coloring agent microparticle dispersion [B] were employed in place of the resin microparticles for core [1] and the coloring agent microparticle dispersion [A], respectively.

Formation Example 2 of Shell Layer

Into the reaction system relating to the above-described core particles [2], added at 65° C. was 49 g (equivalent converted to solids) of the shell resin microparticles [1], and then, stirring was continued over one hour. After that an aqueous solution, in which 54 g of sodium chloride was dissolved in 216 ml of ionized water to stop the shelling. Further, the fusion-bonding was allowed to continue by heating and stirring the solution over one hour after raising the solution temperature to 70° C. Then, the solution temperature was cooled down to 30° C. at a condition of 8° C./min, and the solid was separated from the solution using a basket-type centrifuge "MARK III: model number 60×40" (manufactured by Matsumoto Machine Co., Ltd.) to form a wet cake of toner matrix particles. The above wet cake was repeatedly rinsed with ionized water at 45° C. using the above-described basket-type centrifuge until an electric conductivity of the filtrate reached 5 μS/cm. After that the rinsed wet cake was transferred to "FLUSH JET DRYER" (manufactured by Seishin Enterprise Co., Ltd.), followed by drying until the moisture content reached 0.5% by mass to obtain toner matrix particles [2].

Addition Example 2 of External Additive

To the above toner matrix particles [2], added were hydrophobic silica (a number average primary particle size=12 nm, and a degree of hydrophobicity=68) to a rate of 1% by mass and hydrophobic titanium oxide (a number average primary particle size=20 nm, and a degree of hydrophobicity=63) to a rate of 1.2% by mass, and then, the mixture was blended using "Micro V-Type Mixer" (manufactured by Tsutsui Scientific Instruments Co., Ltd.) to obtain the toner [2] composed of the toner particles [2].

Synthesis Example 3 of Toner Particles

The core particles [1] were prepared in a similar manner to the formation example 1 of core particles. Subsequently, in place of the formation example 1 of a shell layer, a shell layer was formed like a formation example 3 of a shell layer described below to prepare toner matrix particles [3]. Then, to the toner matrix particles [3], an external additive was added in a similar manner to the addition example 1 of an external additive to obtain the toner [3] composed of the toner particles [3].

Formation Example 3 of Shell Layer

Toner matrix particles [3] having a core-shell structure, in which shell resin microparticles [1] were fusion-bonded on the surface of the core particles [3], were prepared in a similar manner to the formation example 1 of a shell layer except that the amount of shell resin microparticles [1] to be added was changed to 39 g (equivalent converted to solids).

Synthesis Example 4 of Toner Particles

Resin microparticles [3] for core were prepared in a similar manner to the formation example 1 of core particles except that no viscous material was used, and in addition, amounts of styrene, n-butylacrylate, methacrylic acid, and n-octyl-3-mercaptopropionate, which were used in the first polymerization and the second polymerization, and an amount of potassium persulfate (KPS) were changed according to prescriptions in Table 1, as well as a ripening treatment time were changed. Then, core particles [3] were formed by using the resin microparticles [3] for core in place of the resin microparticles [1] for core. The weight average molecular weight (Mw), the glass transition temperature (Tg) and volume average particle size of the resin microparticles for core [3] in the resin microparticle dispersion for core [3] were 12,000, 17° C., and 170 nm, respectively. The volume average particle size was measured by employing a dynamic light scattering method particle size analyzer "Microtrac UPA150" (manufactured by Nikkiso Co., Ltd.).

Further, toner [4] composed of toner particles [4] was prepared by conducting similar operations to those of the formation example 1 of a shell layer and the addition example 1 of an external additive.

Synthesis Example 5 of Toner Particles

The core particles [1] were prepared in a similar manner to the formation example 1 of core particles. Subsequently, in place of the formation example 1 of a shell layer, a shell layer was formed like a formation example 4 of a shell layer described below to prepare toner matrix particles [5]. Then, to the toner matrix particles [5], an external additive was added in a similar manner to the addition example 1 of an external additive to obtain the toner [5] composed of the toner particles [5].

Formation Example 4 of Shell Layer

Toner matrix particles [5] having a core-shell structure, in which shell resin microparticles [1] were fusion-bonded on the surface of the core particles [1], were prepared in a similar manner to the formation example 1 of a shell layer except that the amount of shell resin microparticles [1] to be added was changed to 23 g (equivalent converted to solids).

TABLE 1

| | | | No. of Resin Microparticles for Core | | |
|---|---|---|---|---|---|
| | | | 1 | 2 | 3 |
| Latex, | St | (g) | — | 328 | — |
| | BA | | — | 424 | — |
| | MAA | | — | 48 | — |
| | NOMP | | — | 10.3 | — |
| | KPS | | — | 20 | — |
| Viscous Material | | | EVA | Latex [Lx1] | — |
| First Polymerization | St | (g) | 207 | 207 | 230 |
| | BA | | 158 | 158 | 176 |
| | MAA | | 21 | 21 | 21 |
| | NOMP | | 5.9 | 6.1 | 6.6 |
| | Viscous Material | | 113 | 113 | 0 |
| | KPS | | 9.7 | 11.3 | 10.8 |
| Second Polymerization | St | (g) | 338 | 338 | 376 |
| | BA | | 250 | 250 | 278 |
| | MAA | | 37.6 | 37.6 | 41.7 |
| | NOMP | | 10.9 | 18.1 | 12.8 |
| | KPS | | 11.4 | 9.9 | 12.7 |
| Ripening Temperature (° C.) | | | 70 | 70 | 70 |
| Ripening Time (min) | | | 60 | 60 | 80 |
| Tg (° C.) | | | 9 | 0 | 17 |
| Mw | | | 10,000 | 14,900 | 12.00 |

Evaluations of heat resistant storage properties on the above toners [1] to [5] were carried out.

After 100 g of toner was left under a temperature of 55° C. for 24 hours, the toner was put through a sieve of 45 μm openings. The toner was evaluated based on the amount (percentage) of coagulated toner remaining on the sieve using the evaluation basis described below.

Evaluation Basis

A: The amount of the coagulated toner remaining on the sieve is less than 5% by mass, indicating that the amount of the coagulated toner is very small, to result in excellent heat resistant storage properties. (This is a level that even if the toner is transported by commercial carriers in the summer season with no heat insulating materials, no coagulated toner is generated.)

B: The amount of the coagulated toner remaining on the sieve is 5 to 30% by mass, indicating that the amount of the coagulated toner is small, to result in satisfactory heat resistant storage properties. (This is a level that even if the toner is transported by commercial carriers in the summer season only with a cardboard packaging, no coagulated toner is generated.)

C: The amount of the coagulated toner remaining on the sieve is more than 30% by mass, indicating that the amount of the coagulated toner is relatively large, to result in practical problems. (This is a level that a refrigerated transport is required.)

[Preparation Example of Developer]

Each of developers [1] to [5], being a two-component developer, was prepared by blending each of toners [1] to [5] with silicone acryl coated carrier to a ratio of 6:94 by mass.

Examples 1 to 3, Comparative Examples 1 and 2, and Reference Examples 1 and 2

Using each of these developers [1] to [5], the evaluation on image forming method was carried out as described below with the pressure strength as shown in Table 2. The results are shown in Table 2.

(1) Fixing Offset

Using an image forming apparatus, which was manufactured according to FIG. 1, text images with a toner coverage of 3% was printed on 100 sheets under normal temperature and humidity conditions (20° C. and 55% RH) on an A4 size image receiving paper (64 g/m$^2$). After that, stains on the surface of a dielectric drum and on the print were visually observed, and evaluation was carried out using the evaluation basis described below.

Evaluation Basis

A: No stains are observed on the surface of a dielectric drum, and no stain on the printed image due to stains on the surface of the dielectric drum is also observed, to result in a satisfactory fixing offset.

B: Stains are slightly observed on the surface of the dielectric drum, but no stains on the printed image due to stains on the surface of a dielectric drum are observed, resulting in no practical problems.

C: Stains are observed on the surface of the dielectric drum, and in addition, stains on the printed image due to stains on the surface of the dielectric drum are also observed, to result in practical problems.

(2) Fixing Properties Against Rubbing

Using an image forming apparatus, which was manufactured according to FIG. 1, text images were printed on an A4 size image receiving paper (64 g/m$^2$). The resulting print was subjected to a rubbing test in which the print is rubbed three times under a pressure of 1 KPa using a tissue paper "JK WIPER" (produced by Nippon Paper Crecia Co., Ltd.). The result was evaluated using the evaluation basis described below based on visual observation of stains on the surface of the JK WIPER, as well as the rate of decrease in density of text images before and after the rubbing test.

The rate of decrease in density of text images is calculated by the Formula (N) below.

$$\text{rate of decrease in density (\%)}=\{(D0-D1)/D0\}\times 100 \qquad \text{Formula (N)}$$

wherein D0 and D1 represent an absolute reflection density of a print before and after a rubbing test, respectively.

For the determination of the absolute reflection density, a reflection densitometer "RD-918" (manufactured by Macbeth Co.) was used.

Evaluation Basis

A: No stains are observed on the surface of JK WIPER, and the rate of decrease in density of text images is less than 5% (at a satisfactory rating).

B: Stains are slightly observed on the surface of JK WIPER, and the rate of decrease in density of text images is 5% or more and less than 10% (being no practical problem).

C: Stains are observed on the surface of JK WIPER, and the rate of decrease in density of text images is 10% or more (being a practical problem).

(3) State of Image Support

Using an image forming apparatus, which was manufactured according to FIG. 1, text images are printed on an A4 size image receiving paper (64 g/m$^2$). The state of the image support of the resulting print was visually observed.

TABLE 2

| | | | | Pressure Strength | | Evaluation Result | | |
|---|---|---|---|---|---|---|---|---|
| | Toner No. | Core Particles No. | Heat Resistant Storage Properties | First Pressure Roller (kg/cm) | Second Pressure Roller (kg/cm) | Offset Properties | Fixing Properties against Rubbing | State of Image Support |
| Example 1 | 1 | 1 | A | 5 | 9 | A | A | No Change from before Printing |
| Example 2 | 2 | 2 | B | 5 | 9 | B | A | No Change from before Printing |
| Example 3 | 3 | 1 | B | 5 | 9 | B | A | No Change from before Printing |
| Comparative Example 1 | 4 | 3 | A | 5 | 9 | B | C | No Change from before Printing |
| Comparative Example 2 | 1 | 1 | A | 0 | 9 | C | B | No Change from before Printing |
| Reference Example 1 | 5 | 1 | C | 5 | 9 | B | A | No Change from before Printing |
| Reference Example 2 | 1 | 1 | A | 5 | 25 | B | A | Shiny due to being flattened, and partially broken |

The invention claimed is:

1. An image forming method using a toner comprising toner particles having a core-shell structure comprising a core particle incorporating a viscous material and a shell layer covering the core particle, wherein the method comprises steps of;

a toner image forming step on a dielectric drum;

a first pressure applying step in which the shell layer of the toner particles forming the toner image is subjected to a preliminary break treatment by a first pressure roller, which is arranged in contact with the dielectric drum, a pressure strength of the first pressure roller to the dielectric drum is 1 to 10 kg/cm in a linear pressure; and a transfer/fixing step in which a toner image made by the toner particles which have been subjected to a preliminary break treatment by the first pressure applying step is transferred and fixed to an image support by a second pressure roller which is arranged in contact with the dielectric drum.

2. The image forming method of claim 1, wherein a pressure strength of the second pressure roller to the dielectric drum is preferably 5 to 15 kg/cm in linear pressure.

3. The image forming method of claim 1, wherein the viscous material exhibits a glass transition temperature (Tg) in a range of from −30° C. to 5° C.

4. The image forming method of claim 1, wherein a content ratio of the viscous material in the core particles is 10 to 30% by mass.

5. The image forming method of claim 1, wherein the viscous material is a styrene-acrylic resin or an ethylene vinyl acetate copolymer resin (EVA).

6. The image forming method of claim 1, wherein silicone oil of 2 to 20% by mass is incorporated in the core particles of the toner particles.

7. The image forming method of claim 1, wherein the shell layer is composed of a resin having a glass transition temperature (Tg) of 60° C. or higher.

8. The image forming method of claim 1, wherein the toner particles contain a coloring agent, a charge control agent, magnetic powder, or a mold release agent.

9. The image forming method of claim 1, wherein the core particles incorporate other resin than the viscous material.

10. The image forming method of claim 9, wherein the other resin includes a styrene-acryl resin having a glass transition temperature of 5° C. or higher.

11. The image forming method of claim 10, wherein the styrene-acryl resin includes a resin obtained by polymerization of vinyl monomers.

12. The image forming method of claim 1, wherein the core particles have a glass transition temperature (Tg) of from 0 to 25° C.

13. The image forming method of claim 1, wherein weight average molecular weight (Mw) determined via a gel permeation chromatography of the core particles is 5,000 to 15,000.

14. The image forming method of claim 13, wherein the weight average molecular weight (Mw) of the core particles determined via a gel permeation chromatography is 5,000 to 10,000.

15. The image forming method of claim 1, wherein a ratio (Mw/Mn) of weight average molecular weight (Mw) to number average molecular weight (Mn) of the core particles determined via a gel permeation chromatography is 1.0 to 5.5.

16. The image forming method of claim 15, wherein the ratio (Mw/Mn) is 1.5 to 3.5.

17. The image forming method of claim 1, wherein weight average molecular weight (Mw) determined via a gel permeation chromatography of the shell resins is 8,000 to 25,000.

18. The image forming method of claim 1, wherein the weight average molecular weight (Mw) determined via a gel permeation chromatography of the shell resins is 12,000 to 18,000.

19. The image forming method of claim 1, wherein a ratio (Mw/Mn) of weight average molecular weight (Mw) to number average molecular weight (Mn) of the shell resin determined via a gel permeation chromatography is 1.0 to 4.5.

20. The image forming method of claim 18, wherein the ratio (Mw/Mn) of weight average molecular weight (Mw) to number average molecular weight (Mn) determined via a gel permeation chromatography of the shell resin is 1.5 to 2.5.

21. The image forming method of claim 1, wherein thickness of the shell layer is 100 to 300 nm.

22. An image forming method using a toner comprising toner particles having a core-shell structure comprising a core particle incorporating a viscous material and a shell layer covering the core particle, wherein the method comprises steps of;

forming a toner image on a photoreceptor drum;

applying a first pressure on the toner image formed on the photoreceptor drum by a first pressure roller, which is arranged in contact with the dielectric drum, a pressure strength of the first pressure roller to the dielectric drum is 1 to 10 kg/cm in linear pressure; and then, transferring and fixing the toner image on the photoreceptor drum to an image support material by applying pressure by a second pressure roller which is arranged in contact with the photoreceptor drum through the image support material.

* * * * *